US005316882A

United States Patent [19]

Bijay et al.

[11] Patent Number: 5,316,882

[45] Date of Patent: May 31, 1994

[54] FERRITE GREEN BEADS AND METHOD OF PRODUCING CARRIER PARTICLES

[75] Inventors: Shankar S. Bijay; Tsang J. Chen, both of Rochester, N.Y.

[73] Assignee: Eastman Kodak Company, Rochester, N.Y.

[21] Appl. No.: 53,560

[22] Filed: Apr. 23, 1993

Related U.S. Application Data

[63] Continuation of Ser. No. 746,269, Aug. 16, 1991, abandoned.

[51] Int. Cl.[5] ..... G03G 9/10

[52] U.S. Cl. ..... 430/108; 430/106.6; 430/137

[58] Field of Search ..... 430/106.6, 108, 137, 430/904

[56] References Cited

U.S. PATENT DOCUMENTS

| | | | |
|---|---|---|---|
| 3,716,630 | 2/1973 | Shirk | 252/62.63 |
| 3,725,118 | 4/1973 | Fuller et al. | 430/108 |
| 3,795,618 | 3/1974 | Kasper | 430/108 |
| 3,898,170 | 8/1975 | Kasper | 252/62.1 |
| 3,916,064 | 10/1975 | Brown | 428/403 |
| 3,996,392 | 12/1978 | Berg et al. | 427/19 |
| 4,042,518 | 8/1977 | Jones | 252/62.6 |
| 4,053,310 | 10/1977 | Lee | 430/120 |
| 4,075,391 | 2/1978 | Berg et al. | 428/407 |
| 4,126,566 | 11/1978 | Brown | 252/62.1 P |
| 4,297,427 | 10/1981 | Williams et al. | 430/108 |
| 4,342,824 | 8/1982 | Campbell | 430/108 |
| 4,374,192 | 2/1983 | Mayer et al. | 430/108 |
| 4,623,603 | 11/1986 | Iimura et al. | 430/108 |
| 4,729,925 | 3/1988 | Chen et al. | 430/31 |
| 4,822,708 | 4/1989 | Machida et al. | 430/106.6 |
| 4,861,694 | 8/1989 | Aoki et al. | 430/137 |
| 4,868,083 | 9/1989 | Nagatsuka et al. | 430/108 |
| 4,871,639 | 10/1989 | Aoki et al. | 430/108 |
| 4,879,198 | 11/1989 | Tavernier et al. | 430/106.6 |
| 4,906,547 | 3/1990 | Tavernier et al. | 430/106.6 |
| 4,912,004 | 3/1990 | Nagatsuka et al. | 430/106.6 |

FOREIGN PATENT DOCUMENTS

| | | |
|---|---|---|
| 0276874A2 | 8/1988 | European Pat. Off. . |
| 0276874A3 | 11/1989 | European Pat. Off. . |
| 035360A2 | 2/1990 | European Pat. Off. . |
| 0353630A3 | 7/1990 | European Pat. Off. . |
| 56-084402 | 7/1981 | Japan . |
| 56-119141 | 9/1981 | Japan . |
| 56-143446 | 11/1981 | Japan . |
| 56-143447 | 11/1981 | Japan . |
| 57-120946 | 7/1982 | Japan . |
| 59-166968 | 9/1984 | Japan . |
| 60-060930 | 4/1985 | Japan . |
| 60-135958 | 7/1985 | Japan . |
| 61-048430 | 3/1986 | Japan . |
| 61-163348 | 7/1986 | Japan . |
| 61-219054 | 7/1986 | Japan . |
| 62-017758 | 1/1987 | Japan . |
| 62-183470 | 8/1987 | Japan . |
| 01214875 | 8/1989 | Japan . |
| 01282563 | 11/1989 | Japan . |
| 02176763 | 7/1990 | Japan . |

*Primary Examiner*—Marion E. McCamish
*Assistant Examiner*—S. Rosasco
*Attorney, Agent, or Firm*—Willard G. Montgomery

[57] ABSTRACT

A green bead composite for the manufacture of magnetic carrier particles for electrophotography is disclosed. The composite comprises a synthetic polyester or polyurethane as the binder for metal oxide and other metal salt particles. The dried, nonmagnetic green beads are prepared by a spray-drying process. The green beads so prepared are suitable for the production of magnetic carrier particles for electrophotographic development.

24 Claims, No Drawings

FERRITE GREEN BEADS AND METHOD OF PRODUCING CARRIER PARTICLES

This application is a continuation of application Ser. No. 07/746,269, filed Aug. 16, 1991 now abandoned.

FIELD OF THE INVENTION

This invention relates to carrier particles useful in two component developers for electrophotography, and, in particular, to green beads for ferrite carrier particles and a method of producing ferrite carrier particles.

BACKGROUND OF THE INVENTION

In electrophotographic imaging, a latent electrostatic image is formed on a photoconductive element. The image is then rendered visible by a development step in which the latent electrostatic image is contacted with a suitable developer mix.

One method for applying the developer mix is the magnetic brush process, as described in U.S. Pat. No. 3,795,618 to Kasper et al. In this method, developer material containing toner particles and magnetic carrier particles is carried by a magnet. The magnet's field causes the magnetic carrier particles to align in a brush-like configuration. When the "magnetic brush" is engaged with the electrostatic latent-image-bearing surface, the toner particles are drawn from the brush to the latent image by electrostatic attraction.

The role of the carrier particles is two-fold: (a) to transport the toner from the toner sump to the magnetic brush, and (b) to charge the toner by tribo-electrification. In an ideal electrophotographic system, the movement of the carrier particles is passive, i.e., under no circumstances should the carrier particles migrate from the magnetic brush onto the photoconductor. In a non-ideal or real life system, however, some carrier particles also leave the magnetic brush along with the toner particles and are deposited on the photoconductor. This phenomenon is known as "carrier pickup" or "developer pickup."

Several problems result from carrier pickup. First, because the toner laydown on the photoconductor governs the ultimate image quality, the presence of carrier particles among the toner particles in the developed image leads to image artifacts and generally poor image quality. Carrier pickup is particularly detrimental in color applications, because the carrier particles will appear as black specks in otherwise homogeneous color images. In addition, the hard carrier particles become partially entrapped on the relatively soft photoconductor surface, causing permanent local damage to the photoconductor. A damaged photoconductor further enhances the generation of image artifacts.

Generally, the carrier particles which migrate from the magnetic brush onto the photoconductor are much smaller than the mean particle size of the carrier particles. Because of their small size, these particles can be charged to the same sign and extent as toner particles, leading to carrier pickup. Such small particles are produced during the conventional manufacturing process. Therefore, it is very important to eliminate, or significantly reduce, the generation of these small particles, known as "carrier fines", during the carrier manufacturing process.

In the conventional carrier manufacturing process, the constituent metal oxide and other metal salt particles are mixed in a predetermined ratio. This base material is then mixed with a solution of guar gum in water. Guar gum is a natural product which has been widely used in industry because it is inexpensive, non-toxic, soluble, and generally available. It also undergoes nearly complete combustion in the subsequent firing stage, leaving little residue in the magnetic ferrite carrier particles.

The mixture of the constituent metal salts and the guar gum solution is ball milled into a liquid slurry, which is spray dried to form the unreacted nonmagnetic, dried green beads. Spray drying is the most commonly used technique to manufacture green beads. The technique is described in K. Masters, *Spray Drying Handbook*, George Godwin Limited, London, 1979, which is hereby incorporated by reference.

The green beads are subsequently cured or fired at high temperatures, generally between 900° C. to 1500° C. During the firing process, the individual metal salt particles within the individual green beads react to produce the proper crystallographic phase. The magnetic properties of the carrier particles are dictated by the properties of the desired crystallographic phase.

In addition to the problem of carrier pickup, the magnetic properties of the carrier particles can be adversely affected by the generation of fines during the spray drying process. During the firing process, the individual unreacted constituent metal salts bound in the nonmagnetic green bead react to form a magnetic carrier particle. The magnetic character of the carrier particle is controlled by the chemical stoichiometry of the constituting oxides. For optimum carrier performance, it is important that the chemical composition of the green beads be maintained throughout the spray drying process. The disintegration of green beads can result in chemically heterogeneous green particles, which will lead to less than optimum chemical reactions during the firing process, and inferior magnetic performance of the final product.

In the process of manufacturing magnetic carrier particles, it is possible to control firing temperatures and times to avoid over-sintering particles and producing firing-process-induced fines. The generation of fines during atomization for spray-drying can also be eliminated by proper selection of operating conditions, such as the rotational velocity of the disk, fluid pressure and viscosity, and inlet/outlet temperatures. Despite these precautionary efforts, however, extensive fine generation occurs during the manufacturing process.

SUMMARY OF THE INVENTION

We have found that carrier particle fines result to a great extent from the poor binding strength of the conventional materials used to bind the unreacted metal salt particles into "green beads," which upon firing become the magnetic ferrite carrier core. A weak or brittle binder, such as the conventional guar gum binder, will enhance the disintegration of the green beads into smaller particles when a moderately small mechanical stress is exerted on them. The source of such stress during the spray drying process is complex fluid dynamics in which there are inter-particle collisions of dry particles, partially dry particles, and liquid droplets, as well as collision with the wall of the dryer. The net result is fracture and disintegration of large size green beads into several smaller particles, which are generally one-fifth to one-tenth of the size of the original, unbroken bead.

The present invention relates to the use of synthetic polymers, namely polyurethanes and polyesters, to bind the individual unreacted constituent metal salt particles together in the production of non-magnetic green beads, and a method of producing magnetic carrier particles. Both aliphatic and aromatic polyurethanes and polyesters may be used. The resulting green beads have improved fracture toughness and substantially retain their size and shape throughout the spray drying process. The result is a significant reduction in the generation of fines, which in turn leads to an improved magnetic carrier core.

DETAILED DESCRIPTION OF THE INVENTION

In particular, the polyurethanes useful as the binder for the green bead composite of the invention are of the formula (I):

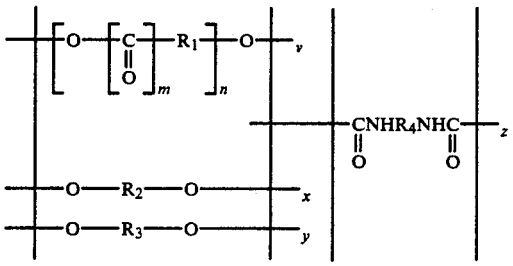

(I)

wherein each $R_1$ group, which may be the same or different from the other $R_1$ groups, is a straight or branched chain aliphatic group of from 2 to 20 carbon atoms, a straight or branched chain aliphatic group of from 2 to 20 carbon atoms having hetero atoms in or appended thereto, or a substituted or unsubstituted arylene, $R_2$ and $R_3$ independently are straight or branched chain aliphatic groups of from 2 to 12 carbon atoms, straight or branched chain aliphatic groups of from 2 to 12 carbon atoms having hetero atoms in or appended thereto, or substituted or unsubstituted arylene groups, $R_4$ is a straight or branched chain aliphatic group of from 4 to 20 carbon atoms, a straight or branched chain aliphatic group of from 4 to 20 carbon atoms having hetero atoms in or appended thereto, a cycloaliphatic group, a substituted or unsubstituted arylene, an alkylene-biscycloaliphatic group, a cycloaliphatic-bisalkylene, an alkylenebisarylene or an arylenebisalkylene, m is 0 or 1, n is about 3 to 500, so that the group

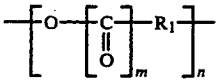

has molecular weight of about 300 to 20,000, x is 0 to 90 v, y is 0 to 90 v, provided that the ratio of (v+x+y) to z is about 0.4 to 1.2, and the molecular weight of the resulting polyurethane is from 5,000 to 1,000,000, preferably from 10,000 to 100,000.

The polyesters useful as the binders for the green bead composite of the invention are represented by the formula (II):

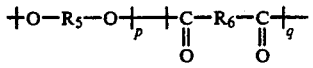

(II)

wherein each $R_5$ and $R_6$ group, which may be the same or different from the other $R_5$ and $R_6$ groups, independently represents a straight or branched chain aliphatic group of from two to 20 carbon atoms, a straight or branched chain aliphatic group of from two to 20 carbon atoms having hetero atoms in or appended thereto, or a substituted or unsubstituted arylene, and p and q represent the number of repeating units in the polyester and are such that the polyester has a molecular weight of 10,000 to 50,000.

"Aliphatic group" refers to divalent alkanes, alkenes, alkadienes and alkynes of from 2 to 20 carbon atoms. These groups are straight or branched chain, and include carboxylic acid, alcohol, ether, aldehyde and ketone functions. These groups also may be substituted with halogen, alkoxy, amide, amine, nitro, ester, and aromatic groups. Cyclic versions of the same groups are suitable cycloaliphatic groups. Exemplary aliphatic groups include ethylene, propylene, isopropylene, butylene, isobutylene, pentylene, neopentylene, hexylene, etc.

$R_1$, $R_2$ and $R_3$ are preferably straight or branched chain lower alkyl groups having from one to six carbon atoms, or a phenylene. $R_4$ is preferably a straight or branched chain lower alkyl group having from one to ten carbon atoms, unsubstituted or substituted with halogen atoms or a phenylene or naphthalene, cyclohexylene, alkylenebiscyclohexylene, or alkylenebisphenylene.

"Arylene" refers to phenylene and naphthalene groups which may be substituted with halogen, alkoxy, and nitro groups. Exemplary arylenes include phenylene, tolylene, xylylene, naphthalene, oxy-diphenylene, methylene diphenylene and diphenylene sulfone.

"Alkylene" refers to divalent alkanes of from 2 to 20 carbons.

The polyurethanes of the present invention are prepared by the reaction of a polyol component and a diisocyanate component. Examples 1–5, below, illustrate the preparation of polyurethanes. In general, 10 to 100 mole percent of the polyol component of the polyurethanes comprises one or a mixture of prepolymers having two or more hydroxy end groups and a molecular weight of from 300 to 20,000, preferably from 500 to 6,000. A wide variety of polyols and diisocyanates may be used in preparing the polyurethanes.

Appropriate polyols include: (1) alkylene diols of from 2 to 10 carbon atoms, arylene diols such as hydroquinone, and polyether diols [HO—(CH2CH2O)n-OH]; (2) triols such as glycerol, 2-ethyl-2-hydroxymethyl-1,3-propanediol, 1,1,1-trimethylolpropane and 1,2,6-hexane-triol; (3) tetra-ols such as pentaerylithritol; (4) higher polyols such as sorbitol; and (5) poly(oxyalkylene) derivatives of the various polyhydric alcohols mentioned. Other desirable polyols include linear polyesters of molecular weights of about 2,000 with terminal hydroxy groups, of low acid numbers and water content, block copolymers of ethylene and propylene oxides with a diamine such as ethylenediamine, and caprolactam polymers having end hydroxy groups.

Suitable diisocyanates include the following commercially available materials: 2,4- and 2,6-toluene diisocyanate, diphenylmethane-4,4-diisocyanate, polymethylene polyphenyl isocyanates, bitolyene isocyanate, dianisidine diisocyanate, 1,5-naphthalene diisocyanate, 1,6-hexamethylene diisocyanate, bis-isocyanatohexyl methane diisocyanate, isophorone diisocyanate, 2,2,4-(2,4,4)trimethylhexamethylene diisocyanate and xylylene diisocyanate.

The ratio of (v+x+y) to z can vary from 0.4 to 1.2 because the polymer may be endcapped with either polyol or diisocyanate precursor. In addition, in the presence of water or any other small molecule chain extenders, e.g., ethylenediamine, diisocyanates can effectively react with themselves by first forming an amino group which is as reactive as the competing hydroxy groups on the diol monomers.

The polyesters defined by the claims are prepared by melt polycondensation, using the typical two-stage process illustrated by the following exemplary reaction sequence:

First stage:

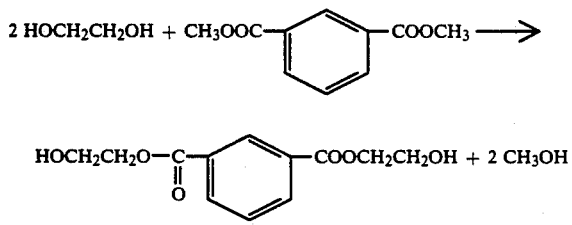

Second Stage:

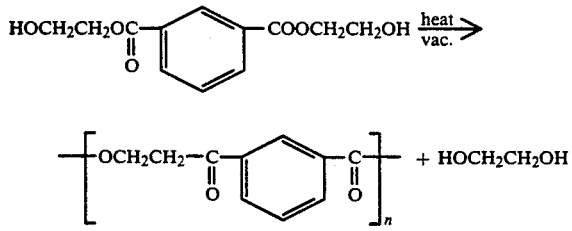

Suitable starting diols include ethylene glycol, diethylene glycol, butenediol, butanediol, and neopentyl glycol. Suitable starting diacids include isophthalic acid, terephthalic acid, maleic acid, fumaric acid, sebacic acid,

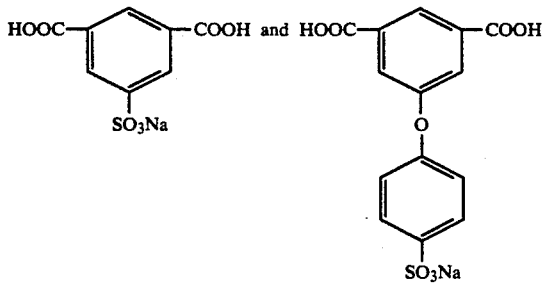

The diacids are used in the form of dimethyl esters.

The green bead composites of the invention are prepared in the following manner. The polyurethane or polyester to be incorporated as the binder is first dispersed in a polar solvent, preferably water. Stabilization of the dispersion may be achieved by the incorporation of anionic or cationic substituents into the polymer. These substituents stabilize the polymer dispersion by imparting a negative or positive charge to the polymer. The anionic or cationic substituents may be incorporated into the polymer by appending them to the $R_2$, $R_3$, $R_4$, $R_5$, or $R_6$ or groups in the prepolymer components. From 5 to 20 mole percent of the $R_2$, $R_3$, $R_4$, $R_5$, or $R_6$ groups may bear an anionic or cationic substituent.

Exemplary cationic substituents which will impart a positive charge to the polymer include tertiary amine groups and phosphonium ions. Suitable anionic substituents which are useful to impart a negative charge to the polymer include sulfonic groups and carboxylic acid groups.

Examples of anionic-substituent bearing prepolymer components include carboxylic acid diols, such as bis-hydroxymethyl propionic acid, or sulfonate diols, such as SIP-diols, prepared by condensing dimethyl sulfoisophthalate, sodium salt, and polyols, as described in U.S. Pat. No. 4,729,925, which is incorporated herein by reference.

The polymer dispersions may contain, on a dry basis, 0.1 to 30 weight percent of the cationic or anionic groups, or their salts, preferably 1 to 10 weight percent.

Additional surfactants, such as dodecyl sulfate, may be added to the polymer dispersions. The dispersions should have a solids content of about 5 to 50 weight percent, preferably about 10 to 20 weight percent.

If water is chosen as the dispersing medium, it is not necessary to use water soluble polymers. Water dispersable polymers may also be used. In fact, water dispersable polymers may have an advantage over water soluble polymers in the elimination of bead fracture.

The constituent metal salts, to be reacted to form the magnetic carrier core upon firing of the green beads, are mixed in the proper ratio. The metal salts are selected from the oxides, the carbonates, the sulfates and the nitrates of the alkaline earth metals, including magnesium, calcium, strontium and barium, and the third and fourth period transition metals, including iron, cobalt, nickel, copper, zinc, cadmium and rhodium. Oxides, particularly iron oxides, in combination with strontium or barium carbonates, are preferred constituent metal salts.

The constituent metal salts are mixed with a dispersion of the polymer, prepared as described above, and the resulting mixture is ball milled for several hours, depending upon the quantity. The liquid slurry, thus prepared, is spray dried according to the method described in K. Masters, *Spray Drying Handbook*, George Godwin Limited, London, 1979. Liquid droplets form during the spray drying process. Upon evaporation, these droplets form individual green beads of substantially uniform particle size and substantially spherical shape.

During the ball milling process, the polymer provides viscous and shear forces. A liquid slurry is produced that has chemical homogeneity and an optimum particle size of the constituent raw materials. During spray drying the solvent (preferably water) in the liquid droplet is evaporated. In the dried droplet, the polymer acts to bind the constituent metal salt particles together.

In order to prepare the magnetic carrier particles, the green beads are cured or fired at temperatures between 900° to 1500° C., generally 1200° to 1400° C., for 10 to 20 hours. During firing, the individual particulates within the green beads react to produce the magnetic carrier particles which, like the green beads, are of substantially uniform particle size and substantially spherical shape. The polymer is degraded and is not present in the magnetic carrier particles.

Preferred polyesters include

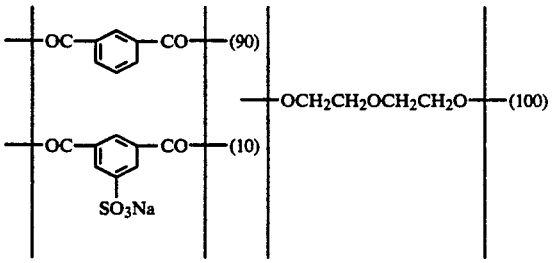

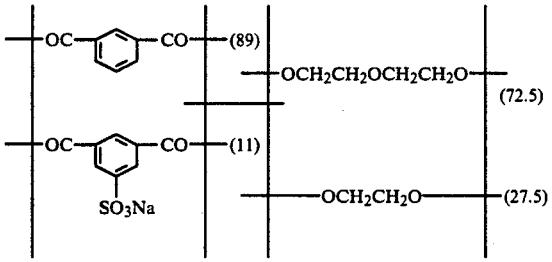

-continued

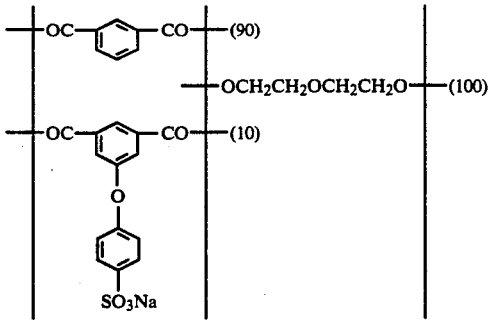

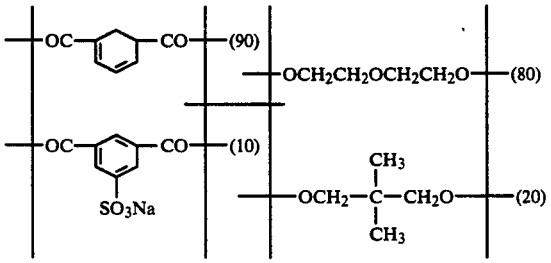

Preferred polyurethanes include

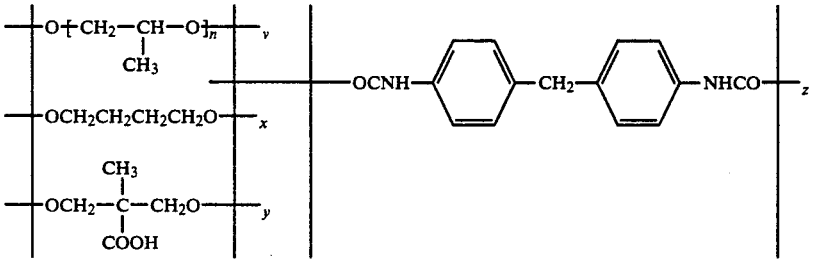

wherein n is 5 to 200;

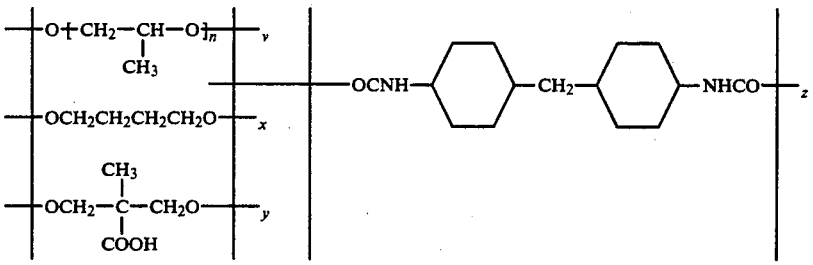

wherein n is 5 to 200;

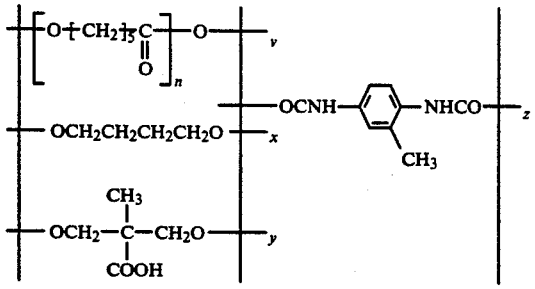

wherein n is from 3 to 100; and

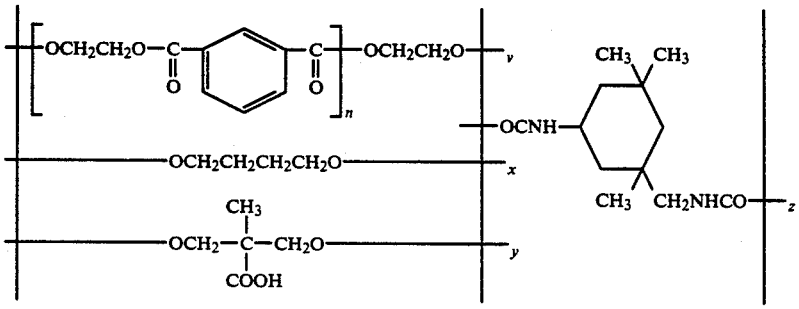

wherein n is from 5 to 100.

The magnetic carrier particles produced by the method of the invention may be combined with toner particles in a two-component developer composition. The toner particles generally comprise a binder and a colorant. Suitable binders and colorants are those described in U.S. Pat. Nos. 5,002,846, 3,893,935, and 4,954,412, and British Patent No. 1,501,065, which are hereby incorporated by reference.

The following non-limiting examples illustrate the preparation of some preferred polymer dispersions, as well as the use of these materials in producing green beads.

EXAMPLE 1

In a one liter three-necked round bottom flask were charged 84 gm. of Pluracol P-1010 polyol (sold by BASF Corporation), 28.43 gm. of 1,4 butanediol, 12.5 gm. of 2,2 dihydroxymethyl propionic acid (DMPA) and 80 gm. of DMF. One gram of stannous octoate was then added and the content was heated to 80° C. under the blanket of nitrogen. 85.08 gm. of tolylene 2,4 diisocyanate (TDI) were added to the reaction mixture over a period of 40 minutes, and stirring was continued at 80° C. for an additional 120 minutes. 10.33 gm. of triethylamine was added over about 10 minutes, and stirring was continued for another 30 minutes. 400 gm. of water was quickly added to the viscous solution to slowly disperse the polymer, until a translucent dispersion was obtained. The solid content was 31.2%. Dry film was clear, flexible and tough.

EXAMPLE 2

The process of EXAMPLE 1 was repeated except that 105 gm. of Pluracol P-1010 polyol, 20.07 gm. of 1,4-butendiol, and 72.42 gm of TDI were used. N-methyl pyrrolidinone (80 gm.) was used as the organic solvent.

EXAMPLE 3

The process of EXAMPLE 1 was repeated except that 105 gm. of Pluracol P-1010 polyol, 21.03 gm. of 1,4-butanediol, and 71.52 gm. of TDI were used. N-methyl pyrrolidinone (80 gm.) was used as the organic solvent.

EXAMPLE 4

The process of EXAMPLE 1 was repeated except that 105 gm. of Tone 230 polyol (available from Union Carbide) was used in place of Pluracol P-1010 polyol, and 20.07 gm. of 1,4-butanediol and 72.42 gm. of TDI were used. Dimethylformamide (DMF) (80 gm.) was used as the organic solvent.

EXAMPLE 5

The process of EXAMPLE 1 was repeated except that 105 gm. of Tone 230 polyol was used in place of Pluracol P-1010 polyol, and 21.03 gm. of 1,4-butanediol and 71.52 gm. of TDI were used. DMF (80 gm.) was used as the organic solvent. 500 gm. of water was used for dispersing the polymer.

EXAMPLE 6

A 4 wt. % stock solution of a polyurethane with Tg at −39° C. was prepared by diluting 98.67 grams of a 30% polymer dispersion with 271.33 gm. of water. The viscosity of the solution was 3.4 cps. In a separate container, 352.09 gm. mixture of iron oxide and strontium carbonate was mixed with 352.09 gm. of stock solution. The mixture was ball milled for approximately 24 hours in the presence of stainless steel balls as the milling media. The spray drying was carried out utilizing the following parameters:

| | |
|---|---|
| Inlet Temperature: | 150–200° C. |
| Outlet Temperature: | 50–100° C. |
| Solution Flow: | 20–50 cc/min |
| Atomizer: | Standard Niro Atomizer |
| Speed: | 20000–40000 rpm |
| Atomizing Pressure: | 20–30 psi |

The green bead, thus obtained, had no fractured or disintegrated beads.

EXAMPLE 7

A 4 wt. % stock solution of a polyurethane with Tg at −53° C. was prepared by dispersing 98.67 gm. of 30% polymer in 271.33 gm. of water. The viscosity of the solution was 3.3 cps. In a separate container, 352.09 gm. mixture of iron oxide and strontium carbonate was mixed with 352.09 gm. of stock solution. The mixture was ball milled for approximately 24 hours in the presence of stainless steel balls as the milling media. The spray drying was carried out utilizing the parameters as mentioned in EXAMPLE 6. There was practically no evidence of bead fracture.

EXAMPLE 8

A 4 wt. % stock solution of a polyester with Tg at 29° C. was prepared by dispersing 74.00 gm. of 20% polymer in 296.00 gm. of water. The viscosity of the solution was 3.5 cps. In a separate container, 352.09 gm. mixture of iron oxide and strontium carbonate was mixed with 352.09 gm. of stock solution. The mixture was ball milled for approximately 24 hours in the presence of stainless steel balls as the milling media. The spray drying was carried out utilizing the parameters as mentioned in EXAMPLE 6. There was no evidence of bead fracture.

EXAMPLE 9

A 4 wt. % stock solution of a polyester with Tg at 38° C. was prepared by dispersing 144.00 gm. of 10% polymer in 216.00 gm. of water. The viscosity of the solution was 3.3 cps. In a separate container, 352.09 gm. mixture of iron oxide and strontium carbonate was mixed with 352.09 gm. of stock solution. The mixture was ball milled for approximately 24 hours in the presence of stainless steel balls as the milling media. The spray drying was carried out utilizing the parameters as mentioned in EXAMPLE 6. There was no evidence of bead fracture.

Although the invention has been described in considerable detail with particular reference to certain preferred embodiments thereof, variations and modifications can be effected within the spirit and scope of the invention.

We claim:

1. A nonmagnetic, dried green bead composite comprising unreacted metal salt particles bound together by a polymer, wherein the polymer is a polyester or polyurethane.

2. A composite according to claim 1, wherein the polyurethane is of formula (I):

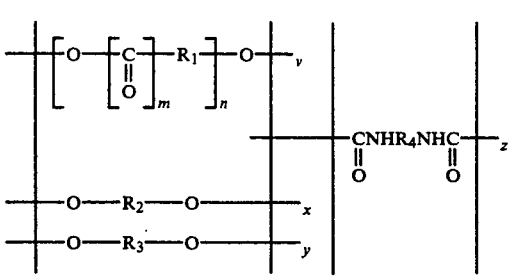

(I)

wherein each $R_1$ group, which may be the same or different from the other $R_1$ groups, is a straight or branched chain aliphatic group of from 2 to 20 carbon atoms, a straight or branched chain aliphatic group of from 2 to 20 carbon atoms having hetero atoms in or appended thereto, or a substituted or unsubstituted arylene, $R_2$ and $R_3$ independently are straight or branched chain aliphatic groups of from 2 to 12 carbon atoms, straight or branched chain aliphatic groups of from 2 to 12 carbon atoms having hetero atoms in or appended thereto, or substituted or unsubstituted arylene groups, $R_4$ is a straight or branched chain aliphatic group of from 4 to 20 carbon atoms, a straight or branched chain aliphatic group of from 4 to 20 carbon atoms having hetero atoms in or appended thereto, a cycloaliphatic group, a substituted or unsubstituted arylene, an alkylenebiscycloaliphatic group, a cycloaliphaticbisalkylene, an alkylenebisarylene group or an arylenebisalkylene, m is 0 or 1, n is about 3 to 500 so that the group has a

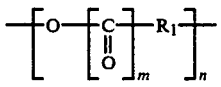

molecular weight of about 300 to 20,000, x is 0 to 90 v, y is 0 to 90 v, provided that the ratio of (v+x+y) to z is about 0.4 to 1.2, and the molecular weight of the resulting polyurethane is from 5,000 to 1,000,000.

3. A composite according to claim 2, wherein the molecular weight of the polyurethane is from 10,000 to 100,000.

4. A composite according to claim 2, wherein $R_1$ is a straight or branched chain lower alkyl group having from one to six carbon atoms, or a phenylene.

5. A composite according to claim 2, wherein $R_2$ and $R_3$ are straight or branched chain lower alkyl groups having from one to six carbon atoms, or phenylene groups.

6. A composite according to claim 2, wherein $R_4$ is a straight or branched chain lower alkyl group having from one to ten carbon atoms, unsubstituted or substituted with halogen atoms, or a phenylene or naphthalene, cyclohexylene, alkylenebiscyclohexylene, or alkylenebisphenylene.

7. A composite according to claim 2, wherein the polyurethane is selected from the group consisting of

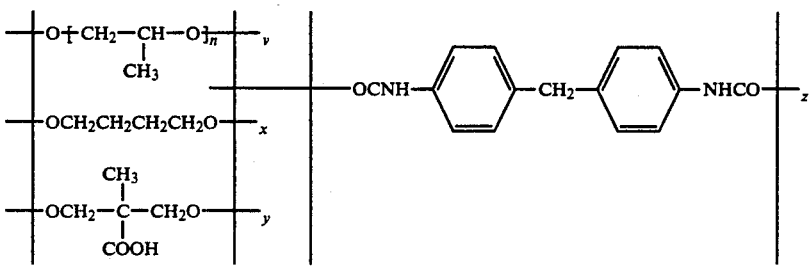

wherein n is 5 to 200;

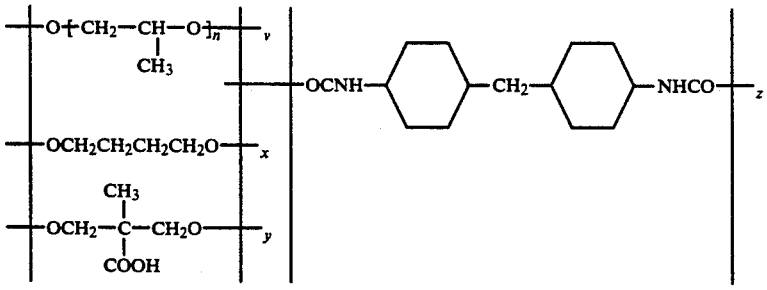

wherein n is 5 to 200;

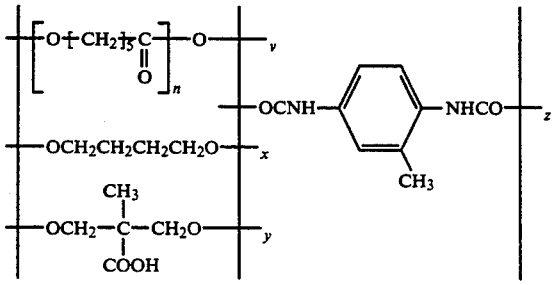

wherein n is from 3 to 100; and

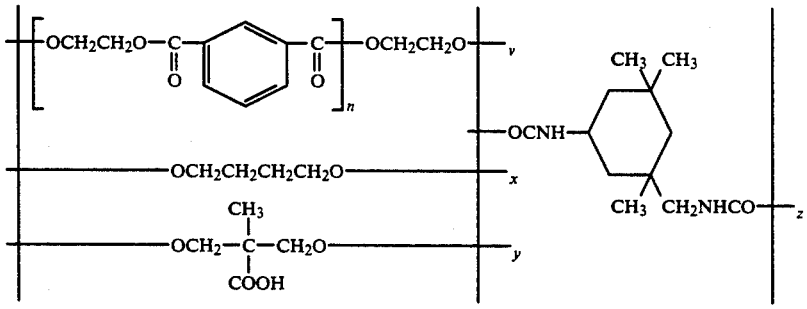

wherein n is from 5 to 100.

8. A composite according to claim 2, wherein the metal salt particles comprise strontium or barium carbonates.

9. A composite according to claim 1, wherein the polyester is of formula (II):

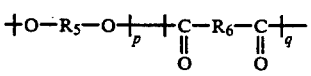

(II)

wherein each $R_5$ and $R_6$ group, which may be the same or different from the other $R_5$ and $R_6$ groups, independently is a straight or branched chain aliphatic group of from two to 20 carbon atoms, a straight or branched chain alphatic group of from two to 20 carbon atoms having hetero atoms in or appended thereto, or a substituted or unsubstituted arylene, and p and q are the number of repeating units in the polymer and are such that the molecular weight of the polyester is from 2000 to 500,000.

10. A composite according to claim 9, wherein the molecular weight of the polyester is from 10,000 to 50,000.

11. A composite according to claim 9, wherein the polyester is selected from the group consisting of

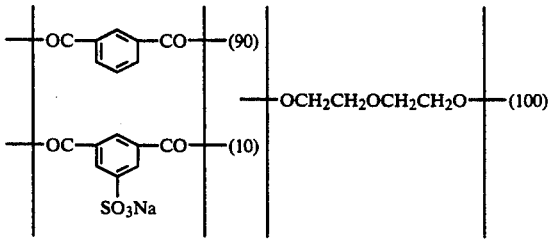

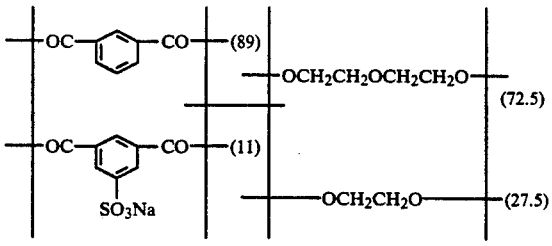

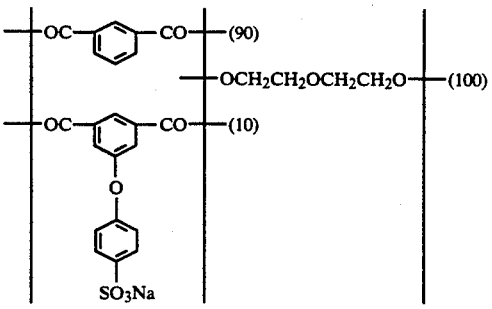

-continued

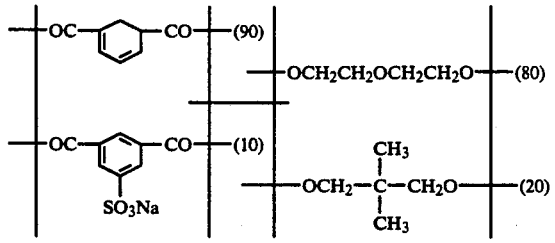

12. A composite according to claim 9, wherein the metal salt particles comprise strontium or barium carbonates.

13. A composite according to claim 1, wherein the metal salt particles comprise strontium or barium carbonates.

14. A method of producing magnetic carrier particles suitable for magnetic brush development of electrostatic charge patterns, comprising:

mixing unreacted metal salt particles with a dispersion of a polymer, wherein the polymer is a polyester or a polyurethane;

spray-drying the mixture of metal salt particles and polymer dispersion to obtain green beads of substantially uniform particle size and substantially spherical shape; and firing the beads to obtain magnetic carrier particles of substantially uniform particle size and substantially spherical shape.

15. A process according to claim 14, wherein the polymer is of formula (I):

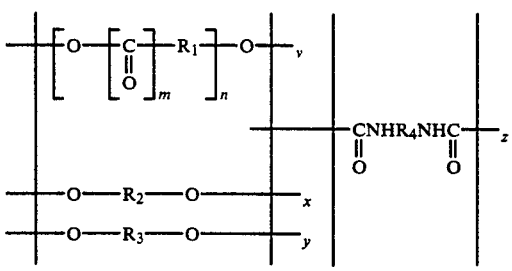

(I)

wherein each $R_1$ group, which may be the same or different from the other $R_1$ groups, is a straight or branched chain aliphatic group of from 2 to 20 carbon atoms, a straight or branched chain aliphatic group of from 2 to 20 carbon atoms having hetero atoms in or appended thereto, or a substituted or unsubstituted arylene, $R_2$ and $R_3$ independently are straight or branched chain aliphatic groups of from 2 to 12 carbon atoms, straight or branched chain aliphatic groups of from 2 to 12 carbon atoms having hetero atoms in or appended thereto, or substituted or unsubstituted arylene groups, $R_4$ is a straight or branched chain aliphatic group of from 4 to 20 carbon atoms, a straight or branched chain aliphatic group of from 4 to 20 carbon atoms having hetero atoms in or appended thereto, a cycloaliphatic group, a substituted or unsubstituted arylene, an alkylenebiscycloaliphatic group, a cycloaliphaticbisalkylene, an alkylenebisarylene or an arylenebisalkylene, m is 0 or 1, n is about 3 to 500 so that the group

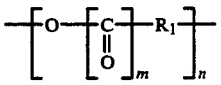

has a molecular weight of about 300 to 20,000, x is 0 to 90 v, y is 0 to 90 v, provided that the ratio of (v+x+y) to z is about 0.4 to 1.2, and the molecular weight of the resulting polyurethane is from 5,000 to 1,000,000.

16. A process according to claim 14, wherein the polymer is of formula (II):

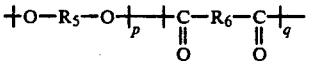

(II)

wherein each $R_5$ and $R_6$ group, which may be the same or different from the other $R_5$ and $R_6$ groups, independently is a straight or branched chain aliphatic group of from two to 20 carbon atoms, a straight or branched chain aliphatic group of from two to 20 carbon atoms having hetero atoms in or appended thereto, or a substituted or unsubstituted arylene, and p and q are the number of repeating units in the polymer and are such that the molecular weight of the polyester is from 2000 to 500,000.

17. A process according to claim 14, further comprising:

stabilizing the dispersion by incorporating in the polymer substituents which impart a positive or negative charge to the polymer.

18. A process according to claim 17, wherein the substituents which impart a positive charge to the polymer are tertiary amine groups or phosphonium ions.

19. A process according to claim 17, wherein the substituents which impart a negative charge to the polymer are sulfonic groups or carboxylic acid groups.

20. A process according to claim 17, wherein the dispersion is water-based and the metal salt particles comprise strontium or barium carbonates.

21. A process according to claim 14, wherein the metal salt particles comprise strontium or barium carbonates.

22. A process according to claim 14, wherein the dispersion is water-based.

23. The product by the process of claim 14.

24. A dry developer composition for developing electrostatic images, comprising:

(a) toner particles comprising a mixture of a binder and a colorant, and (b) the carrier particles produced by the process of claim 14.

* * * * *

UNITED STATES PATENT AND TRADEMARK OFFICE

CERTIFICATE OF CORRECTION

PATENT NO. : 5,316,882

DATED : May 31, 1994

INVENTOR(S) : Bijay S. Saha and Tsang J. Chen

It is certified that error appears in the above-indentified patent and that said Letters Patent is hereby corrected as shown below:

On the title page: Item [75]

The first named inventor should be changed from "Shankar S. Bijay" to --Bijay S. Saha--.

In column 12, line 24 delete "has a" and at column 12, line 31 before "molecular weight", insert --has a--.

Signed and Sealed this

Eighth Day of November, 1994

*Attest:*

Bruce Lehman

BRUCE LEHMAN

*Attesting Officer*

*Commissioner of Patents and Trademarks*